US005161996A

United States Patent [19]

Locati

[11] Patent Number: 5,161,996

[45] Date of Patent: * Nov. 10, 1992

[54] HEADER ASSEMBLY AND ALIGNMENT ASSIST SHROUD THEREFOR

[75] Inventor: Ronald P. Locati, Harrisburg, Pa.

[73] Assignee: AMP Incorporated, Harrisburg, Pa.

[ * ] Notice: The portion of the term of this patent subsequent to Aug. 6, 2008 has been disclaimed.

[21] Appl. No.: 736,185

[22] Filed: Jul. 26, 1991

[51] Int. Cl.[5] ..... H01R 13/629

[52] U.S. Cl. ..... 439/374

[58] Field of Search ..... 439/64, 374, 376, 377, 439/380, 381

[56] References Cited

U.S. PATENT DOCUMENTS

| | | | |
|---|---|---|---|
| 3,264,599 | 8/1966 | Kinkaid | 339/17 |
| 3,325,771 | 6/1967 | Ruehlemann et al. | 339/184 |
| 3,474,395 | 10/1969 | Ferdon et al. | 339/186 |
| 3,518,620 | 6/1970 | Bushey et al. | 339/184 |
| 3,601,770 | 8/1971 | Bowley | 339/125 R |
| 3,685,001 | 8/1972 | Krafthefer | 339/17 L |
| 3,768,066 | 10/1973 | Mattingly, Jr. et al. | 339/65 |
| 3,966,290 | 6/1976 | Little et al. | 339/17 LC |
| 4,193,108 | 3/1980 | Romano | 361/399 |
| 4,204,737 | 5/1980 | Faber et al. | 339/65 |
| 4,350,409 | 9/1982 | Kato et al. | 339/186 M |
| 4,530,561 | 6/1985 | Tyree et al. | 339/134 |
| 4,586,254 | 5/1986 | Ammon et al. | 29/884 |
| 4,603,929 | 8/1986 | Fitzpatrick | 339/17 C |
| 4,664,462 | 5/1987 | Owens | 339/65 |
| 4,929,183 | 5/1990 | Rinneburger | 439/67 |
| 5,035,641 | 7/1991 | Van-Santbrink et al. | 439/329 |
| 5,037,323 | 8/1991 | Locati | 439/374 |
| 5,129,831 | 7/1992 | Locati | 439/374 |

FOREIGN PATENT DOCUMENTS

| | | |
|---|---|---|
| 0201686 | 2/1987 | European Pat. Off. . |
| 6503360 | 9/1965 | Netherlands . |

OTHER PUBLICATIONS

IBM Technical Disclosure Bulletin vol. 33, No. 1A, Jun. 1990.

AMP Catalog No. 73-177, p. 9, streamlined Mar. 1989.

*Primary Examiner*—Gary F. Paumen

*Attorney, Agent, or Firm*—David L. Smith

[57] ABSTRACT

There is disclosed an alignment and blind mate assist shroud 22,22' having a body section securable to a shrouded header 20,20' and an extension section adapted to extend beyond the shrouded header 20,20'. The body section has means cooperable with the shrouded header for securing the shroud 22,22' to the shrouded header 20,20'. The extension section has guide means 112,114 which taper inwardly toward the walls 30,32,34,36 for guiding a complementary connector into the shrouded header 20,20'. An alternate embodiment shroud 22''' has protrusions 300, 302, 304 cooperable with detents 306, 308, 312, 314 in a mating connector to provide additional retention of the mating connector.

20 Claims, 8 Drawing Sheets

HEADER ASSEMBLY AND ALIGNMENT ASSIST SHROUD THEREFOR

BACKGROUND OF THE INVENTION

This invention relates to electrical connectors and, in particular, to an alignment and blind mate assist shroud for securing to an electrical connector to assist in aligning a complementary connector during mating of the two connectors as well as maintaining alignment of the complementary connector during unmating of the two connectors.

Many pin headers have a shroud that extends to the same height as the pin field in the header. The purpose of having a shroud that does not extend beyond the pin field is to save space. A complementary mating connector is typically terminated to a ribbon cable. When the complementary connector is mated to the pin field in the pin header, the shroud permits the cable to extend transverse to the pins substantially at the edge of the shroud and only slightly beyond the end of the pins of the pin field.

Several problems have resulted from having the shroud and pins extend to substantially the same height above the base of a pin header. Blind mating is not practical as there is no shroud structure to provide guidance to the complementary connector. When mating a complementary connector to such a pin header, there is no structure on the pin header to assure that the pins in the pin header and the receptacle contact in the complementary connector are aligned before forces that would tend to mate the connectors if they were aligned are applied. This can be potentially damaging, resulting in bent pins. Upon unmating a mated complementary connector from such a pin header there is nothing to prevent the mating connector from being tilted and thus removed in an arc rather than being removed parallel to the direction of the pins within the shroud since there is not shroud structure extending above the pin field. Such an arcuate removal path, known as peeling, can result in bent pins.

There is disclosed in U.S. Pat. No. 4,664,462 a two-piece shroud for securing to a back panel about an aperture therethrough. The two-piece shroud provides latching and aligning means for a mating connector received by a bulkhead connector mounted on the opposite side of the panel.

It would be desirable to have a retrofittable structure easily securable to an electrical connector such as a pin header to provide a pin header which has a shroud that extends to the same height of the pin field with structure extending beyond the pin field that would provide alignment of a complementary connector prior to mating, permit blind mating and maintain alignment during unmating so as to prevent damage to the pins.

SUMMARY OF THE INVENTION

In accordance with the present invention, an alignment and blind mate assist shroud having a body section securable to a shrouded header and an extension section adapted to extend beyond the shrouded header is disclosed. The body section has means cooperable with the shrouded header for securing the shroud to the shrouded header. The extension section has guide means which taper inwardly toward the sidewalls for guiding a complementary connector into the shrouded header.

DESCRIPTION OF THE PREFERRED EMBODIMENT

Figure 1:
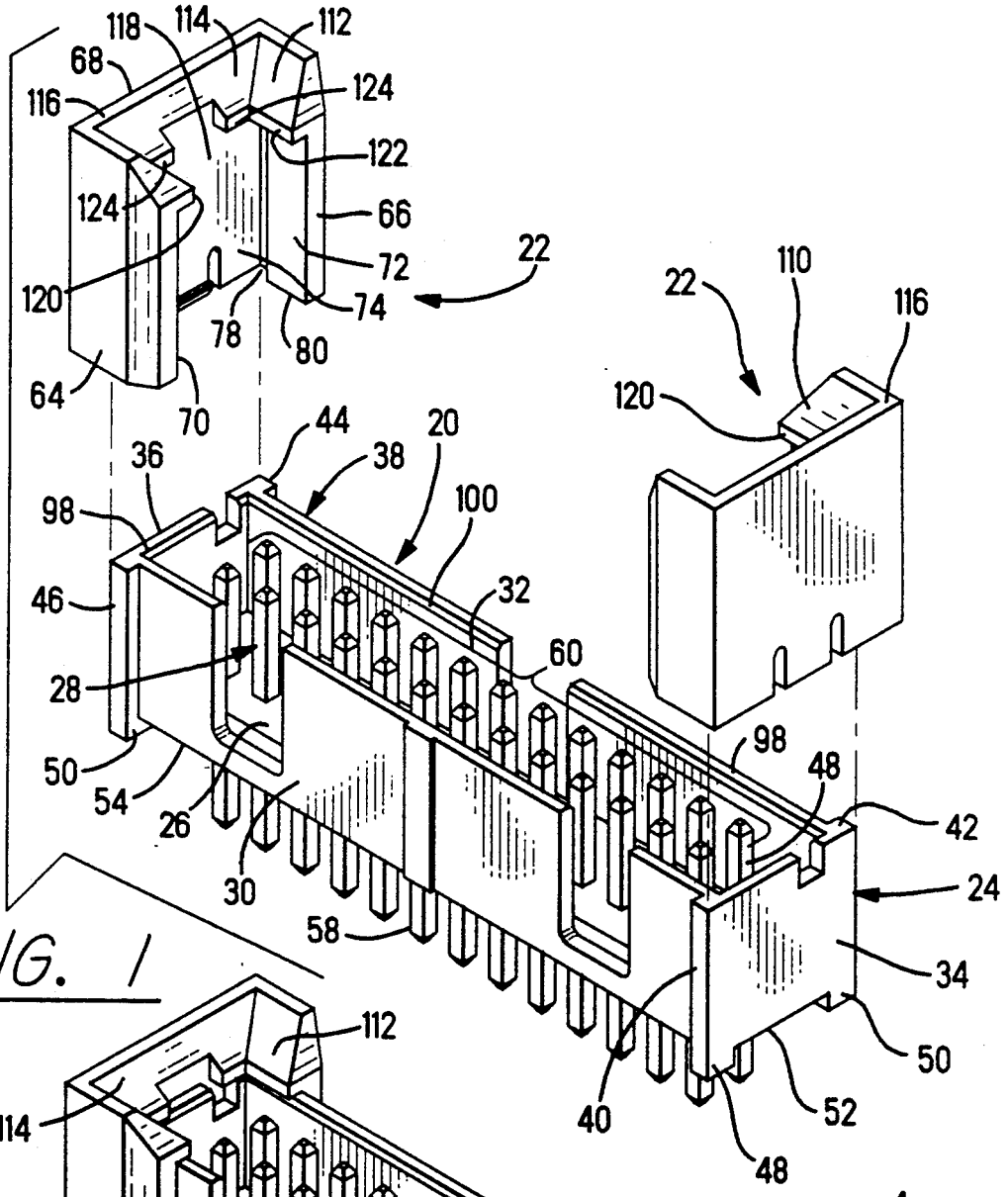
FIG. 1 is a perspective view of a pin header having two alignment and blind mate assist shrouds in accordance with the present invention, exploded therefrom.

FIG. 1 illustrates a pin header 20 having two alignment and blind mate assist shrouds 22 in accordance with the present invention positioned thereabove. Pin headers 20 include a housing 24 molded of a suitable plastic having base 26 through which pins 28 extend. Housing 24 is elongate and includes sidewalls 30 and 32 integral with and extending transverse to base 26, and endwalls 34 and 36 also integral with an extending transverse to base 26. Walls 30, 32, 34, and 36 surround pins 28 to define shroud 38. Endwalls 34 and 36 extend outwardly beyond sidewalls 30 and 32 to form substantially identical ribs 40, 42, 44 and 46. Endwalls 34 and 36 extend downward from base 26 to form standoffs 48 and 50 with recesses 52, substantially coplanar with bottom surface 54 of base 26, therebetween. Pins 28 are typically 0.025 inch (0.635 mm) square 0.100 inch (2.54 mm) center lines both between adjacent pins in a row and between rows of pins. Pins 28 having a mating portion 56 extending upwardly from base 26 substantially the height of shroud 38 and a solder tail portion 58 extending below base 26 for reception in plated through holes in a circuit board (not shown). Pins 28 are secured in base 28 and form an array 60. A typical pin header is part no. 103308-6 sold by the assignee.

Figure 2:
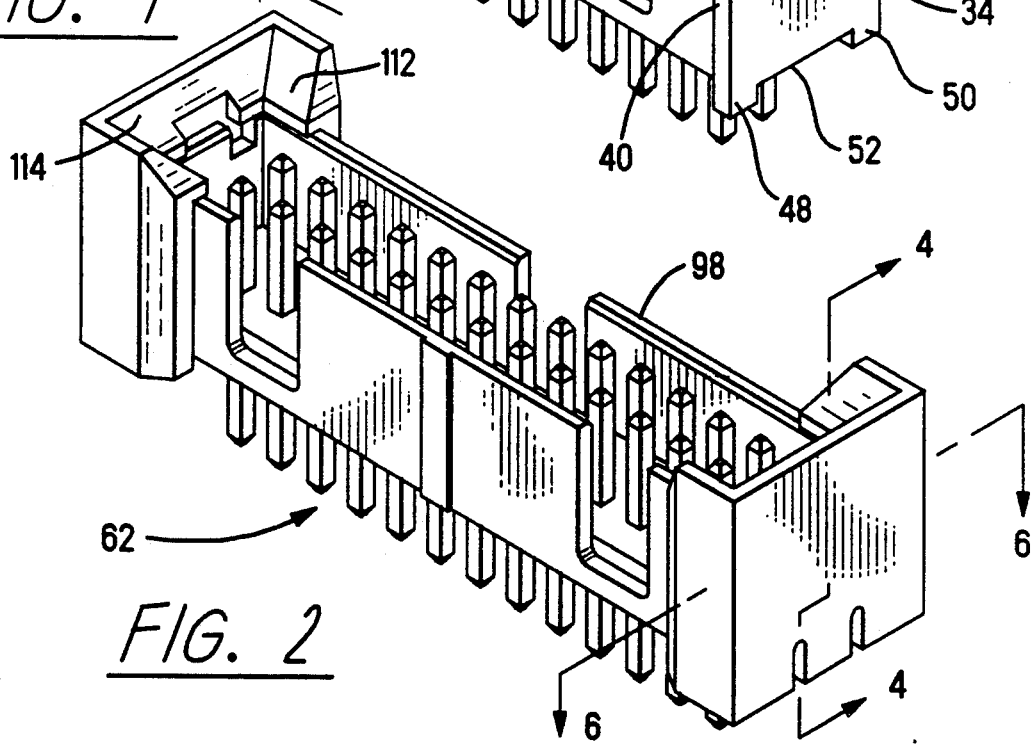
FIG. 2 is a perspective view of a pin header assembly in accordance with the present invention including two alignment and blind mate assist shrouds.

Alignment and blind mate assist shrouds 22 shown exploded from endwalls 34 and 36 in FIG. 1, as well as secured to pin header 20 in FIG. 2 forming assembly 62 are identical and therefor only one need be described. Shrouds 22 are molded of a suitable plastic.

Figure 3:
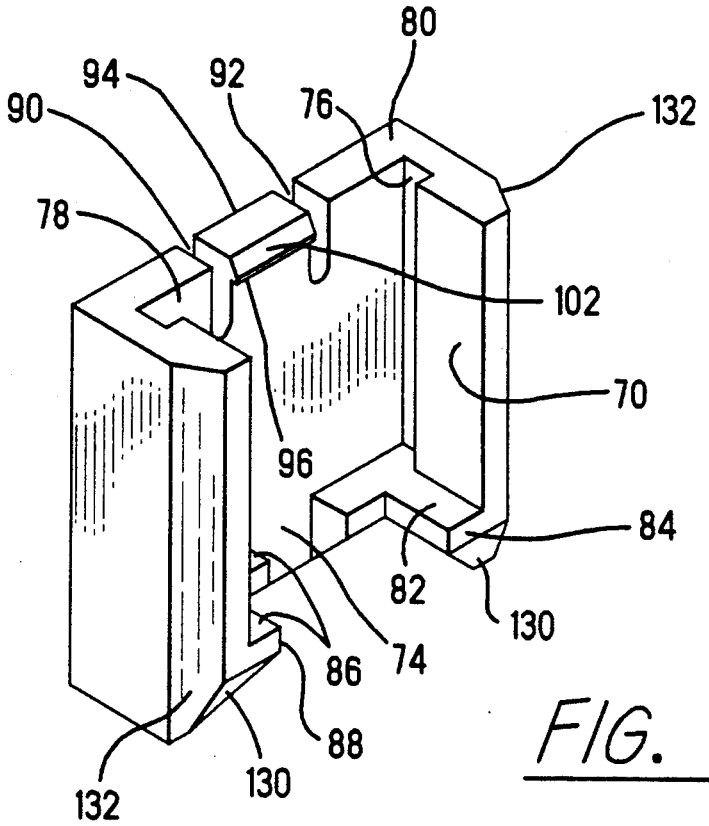
FIG. 3 is a bottom perspective view of an alignment and blind mate assist shroud.

As best seen in FIGS. 1 and 3, shroud 22 is substantially U-shaped in cross section having side member 64 and 66 interconnected by end member 68. Each shroud 22 consists of a body portion securable to pin header 20 and an extension portion adapted to extend above shroud 38 to assist in aligning a complementary connector during mating or unmating thereof. Inner surfaces 70 and 72 of side members 64 and 66 respectively are spaced substantially as the outer surface of sidewalls 30 and 32. Extending into side members 64 and 66 beyond surfaces 70 and 72 adjacent to inner surface 74 of end member 68 are channels 76 and 78. Channel 76 is complementary to ribs 46 or 42 and extend from bottom surface 80 to the lower surface 82 of offset 84. Similarly channel 78 is complementary to ribs 40 or 44 and extends from bottom surface 80 to the lower surface 86 of offset 88.

End member 68 has a pair of spaced slots 90, 92 extending upwardly from bottom surface 80 defining therebetween latch 94. Latch 94 provides a latch shoulder 96 extending inwardly from inner surface 74 and spaced from lower surfaces 82 and 86 substantially the distance from top surface 98 of shroud 38 to notch 52, which is typically the bottom surface 54 of base 26. Top surface 98 may be beveled at the inner edge 100. Ramp surface 102 extends from bottom surface 80 angularly upwardly toward latch shoulder 96 to facilitate positioning.

Figure 4:
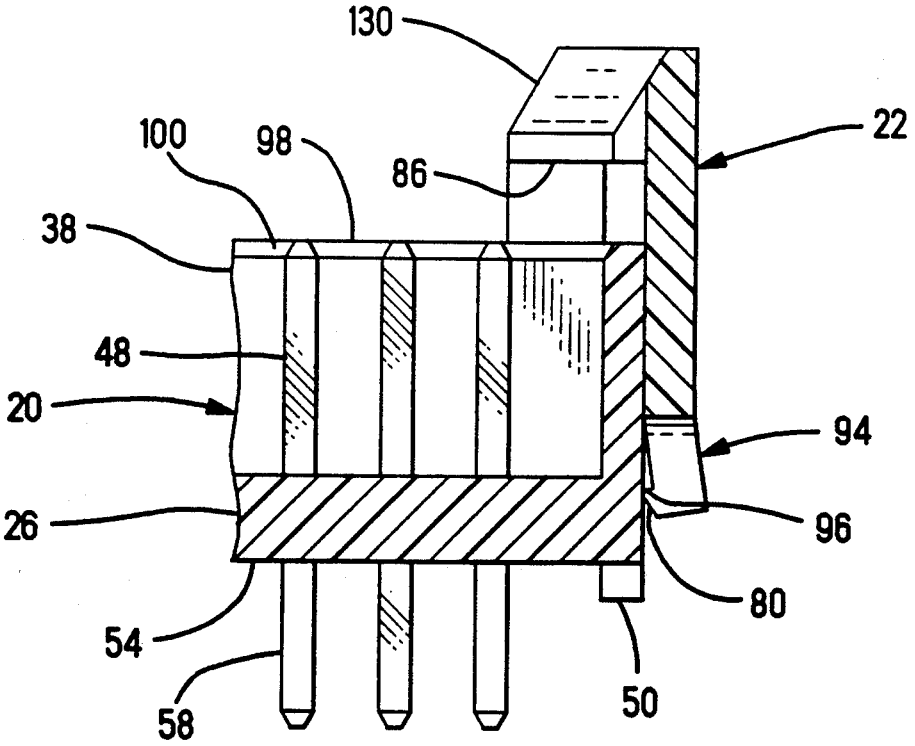
FIG. 4 is a partial cross section, taken along the lines 4—4 of FIG. 2, of a pin header having an alignment and blind mate assist shroud partially installed thereon.

To attach alignment and blind mate assist shrouds 22 to pin header 20, shrouds 22 are first positioned above top surface 98 with channels 76 and 78 aligned respectively with ribs 42 and 40 or 46 and 44, sidewalls 30 and 32 aligned between inner surfaces 70 and 72, and inner surface 74 substantially coplanar with the outer surface of a respective endwall 34, 36. Shroud 22 and pin header 20 are then moved toward each other. As ribs begin to be received in channels 76, 78, ramp surface 102 engages top surface 98 of shroud 38 at an endwall. The reactionary forces resulting from continued movement of shroud 22 and pin header 20 toward each other causes latch 94 to flex outwardly until the inner edge of ramp surface 102 rides over the endwall. As latch 94 slides along endwall 34, the inner edge 104 slides along a respective endwall 34 or 36 as shown in FIG. 4. When latch shoulder 96 passes beyond bottom surface 54 in recess 52, latch 94 resiles inwardly to latch beneath bottom surface 54 to secure shroud 22 to pin header 20 resulting in assembly 62.

Figure 5:
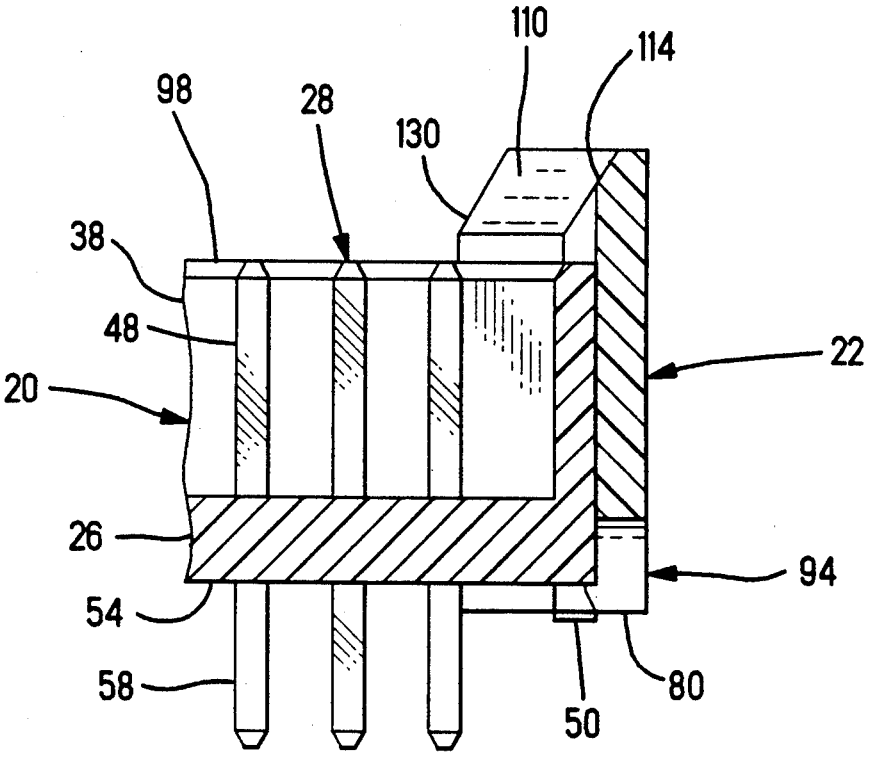
FIG. 5 is a partial cross section, taken along lines 4—4 of FIG. 2, through a pin header having an alignment and blind mate assist shroud secured thereto.

In the preferred embodiment as best seen in the partial cross section of FIG. 5, with latch shoulder 96 latched under bottom surface 54, bottom surfaces 80 and 82 engage the top surface 98 of shroud 38. This structure provides means on the shroud cooperable with the header to secure the shroud to the header. Shroud 22 is secured to pin header 20 in a predetermined location with the vertical position of shroud 22 maintained relative to pin header 20.

Figure 6:
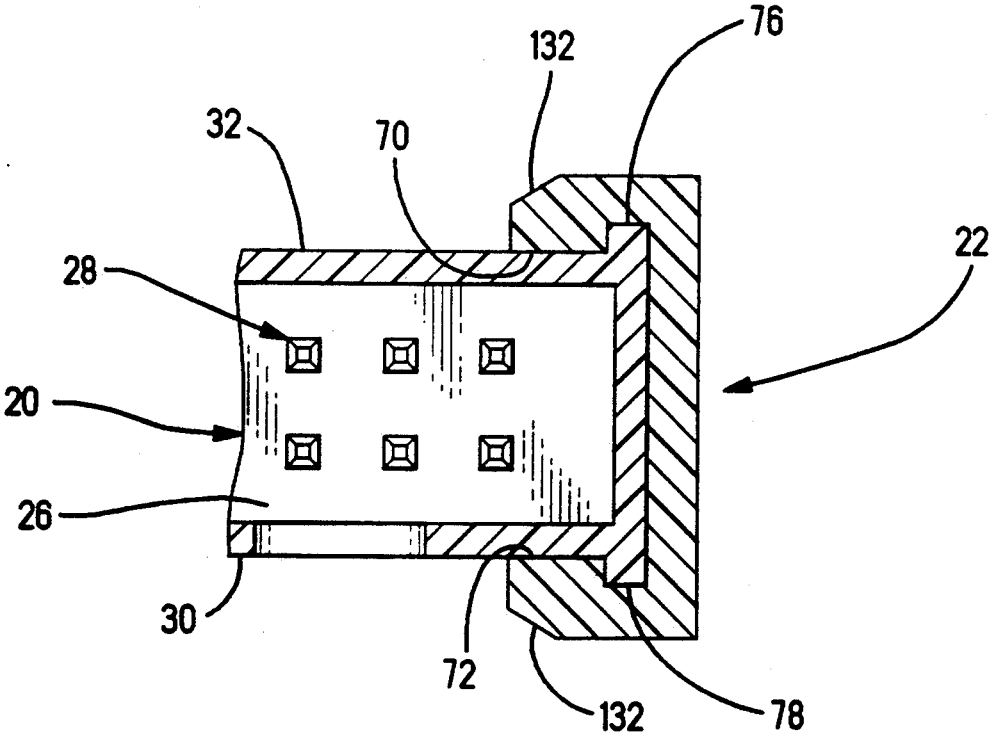
FIG. 6 is a partial cross section, taken along lines 6—6 in FIG. 2, through an end of a pin header having an alignment and blind mate assist shroud secured thereto.

As best seen in the partial cross section of FIG. 6, the ribs and channels complement each other to provide means on the shroud cooperable with the header to secure shroud 22 to pin header 20. Inner surfaces 70 and 72, sidewalls 30 and 32, ribs 40 and 42, channels 76 and 78, endwalls 34 and 36 as well as inner surface 74 cooperate to secure shroud 22 on pin header 20 in a predetermined location with the horizontal position of shroud 22 maintained relative to pin header 20. With shroud 22 positioned on and secured to pin header 20 as described above, resulting in assembly 62 shown in FIG. 2, shroud 22 provides an alignment and blind mating function for a complementary receptacle connector, not shown. A typical complementary receptacle connector is part no. 746285-6 sold by the assignee.

Side members 64 and 66 as well as end member 68 extend above top surface 98 of shroud 38 and provide beveled surfaces 110, 112 and 114 respectively which taper inwardly in a direction from top surface 116 to bottom surface 80. Beveled surfaces 110, 112 and 114 collectively provide lead-in for the complementary connector prior to mating. Recess 118 in beveled surface 114 permits a core pin to be positioned during molding of shroud 22 to form latch shoulder 96. Each of beveled surfaces 110, 112 and 114 extend to respective limited height vertical surfaces 120, 122 and 124.

Vertical surface 122 defines the innermost edge of offset 88 which defines the innermost edge of lower surface 86. In the preferred embodiment, vertical surface 122 when shroud 22 is secured on pin header 20 is substantially coplanar with inner surface of sidewall 32. In the preferred embodiment this results in offset 88 along side member 66 being substantially the same depth as sidewall 32 is thick. Similarly, vertical surface 122 defines the innermost edge of offset 84 which defines the innermost edge of lower surface 82. Vertical surface 120, when shroud 22 is secured on pin header 22, is substantially coplanar with the inner surface of sidewall 30. In the preferred embodiment this results in offset 84 along side member 66 being substantially the same depth as sidewall 30 is thick.

Vertical surface 124 defines the innermost edge of offsets 84 and 88 along inner surface 74. Vertical surface 124, when shroud 22 is secured on pin header 20 is substantially coplanar with the inner surface of endwall 36. Thus when a complementary connector is aligned to pass vertical surface 124 it is properly aligned for mating with pins 28 of array 60.

Beveled surfaces 110, 112 and 114 permit a complementary connector to initially be misaligned and guide the complementary connector to a position of alignment. As a complementary connector is moved toward pin header 20 to mate therewith, the complementary connector, if not properly aligned for mating, will engage one or more of the beveled surfaces 110, 112 or 114 on a shroud 22. As the complementary connector continues to move toward pin header 20 for mating, reactionary forces between the complementary connector and beveled surfaces 110, 112 or 114 will cause the complementary connector to align with the pin header prior to mating. The beveled surfaces extend into vertical surfaces 120, 122 and 124 which further assure alignment prior to mating. The vertical surfaces also maintain alignment of the complementary connector with the pin header during unmating to prevent tilting or peeling of the complementary connector arcuately away from the pin header in a manner that could damage the pins. In this manner, shrouds 22 obviate the problems of misregistration and misalignment as well as bent pins that were a result of misalignment.

Beveled edges 130 provide a cable guide between edges 130 on the shrouds on opposite ends of pin header 20. Beveled corners 132 taper the thickness of side members 64, 66 to be narrower at distal edges thereof.

Shrouds 22 provide several advantages. The shrouds are retrofittable and thus can be added after the pin header is placed in service. Placing a shroud only at the ends of a pin header, as opposed to extending the height along the entire length of the pin header, continues to permit a right angle cable exit with the cable passing substantially across the top surface of the shroud. A pin header can be useful in a blind mating environment when shrouds 22 are utilized. Furthermore, shrouds 22 can be manufactured of various colors for color coding which one of several otherwise identical pin connectors a particular complementary connector mates with.

Figure 7:
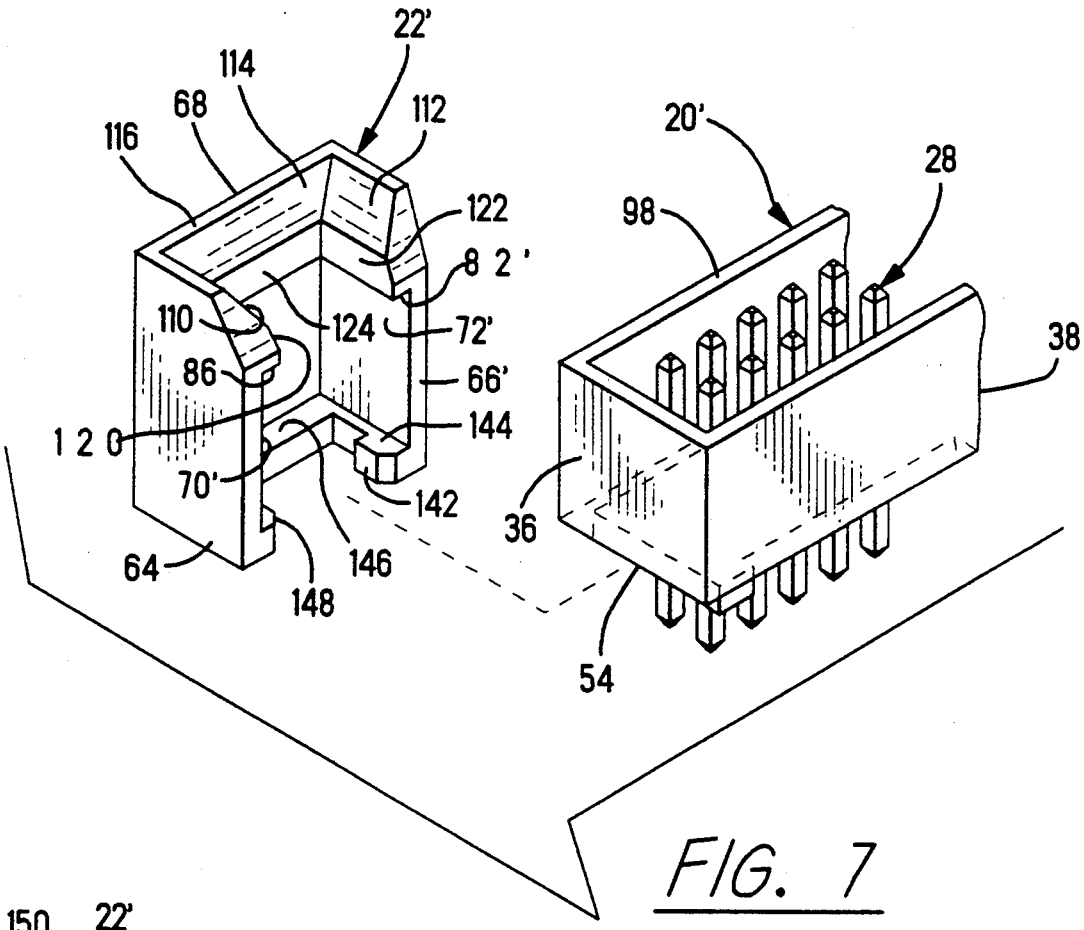
FIG. 7 is a partial perspective view of an alternate embodiment pin header and alignment and blind mate assist shroud exploded therefrom.
Figure 8:
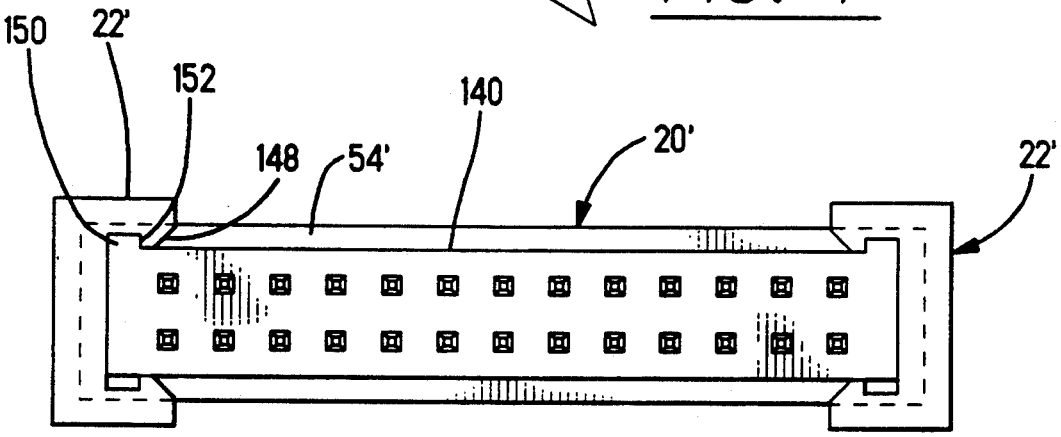
FIG. 8 is a bottom view of an assembly of two alternate embodiment alignment and blind mate assist shrouds secured on an alternate embodiment pin header, such as those disclosed in FIG. 7.

An alternate embodiment pin header 20' and alignment and blind mate shroud 22' is shown in FIG. 7. Shroud 22' functions in the same manner as shroud 22, with the difference being the structure that secures shroud 22 to a pin header. Shroud 22' slides onto the end of pin header 20' as indicated by the broken line in FIG. 7. Shroud 22 has an inwardly directed protrusion 142 extending from the inside surface 72' of side member 66'. Shroud 22' is received over the end of pin header 22' such that pin header 22' is vertically positioned by top surface 98 being received along lower surface 82' and bottom surface 54' being received along the top surface 144 of protrusion 142 and shoulder 146. This structure prevents shroud 22 once mounted on pin header 20 from moving vertically on pin header 20. Since the outside surfaces of sidewalls 30 and 32 are closely received between inner surfaces 70' and 72', shroud 72 does not move sideways on pin header 20. This structure, in conjunction with protrusion 142 cooperating with raised base 140, shown in phantom in FIG. 7 and better seen from the bottom view of FIG. 8, provide means to secure shroud 22' to pin header 20'.

As shroud 22' is pressed onto pin header 20', side member 62' flexes outwardly with ramp surface 148 riding over extension 150 on raised base 140. As latch shoulder 152 passes beyond extension 150, side member 62' resiles inwardly to secure shroud 22' on pin header 20'.

Since raised base 140 may be asymmetrical, it is not necessary that shroud 22' be symmetrical. However, a symmetrical shroud 22 could permit only one shroud 22' to be molded and be used on either end of pin header 20'.

Figure 9:
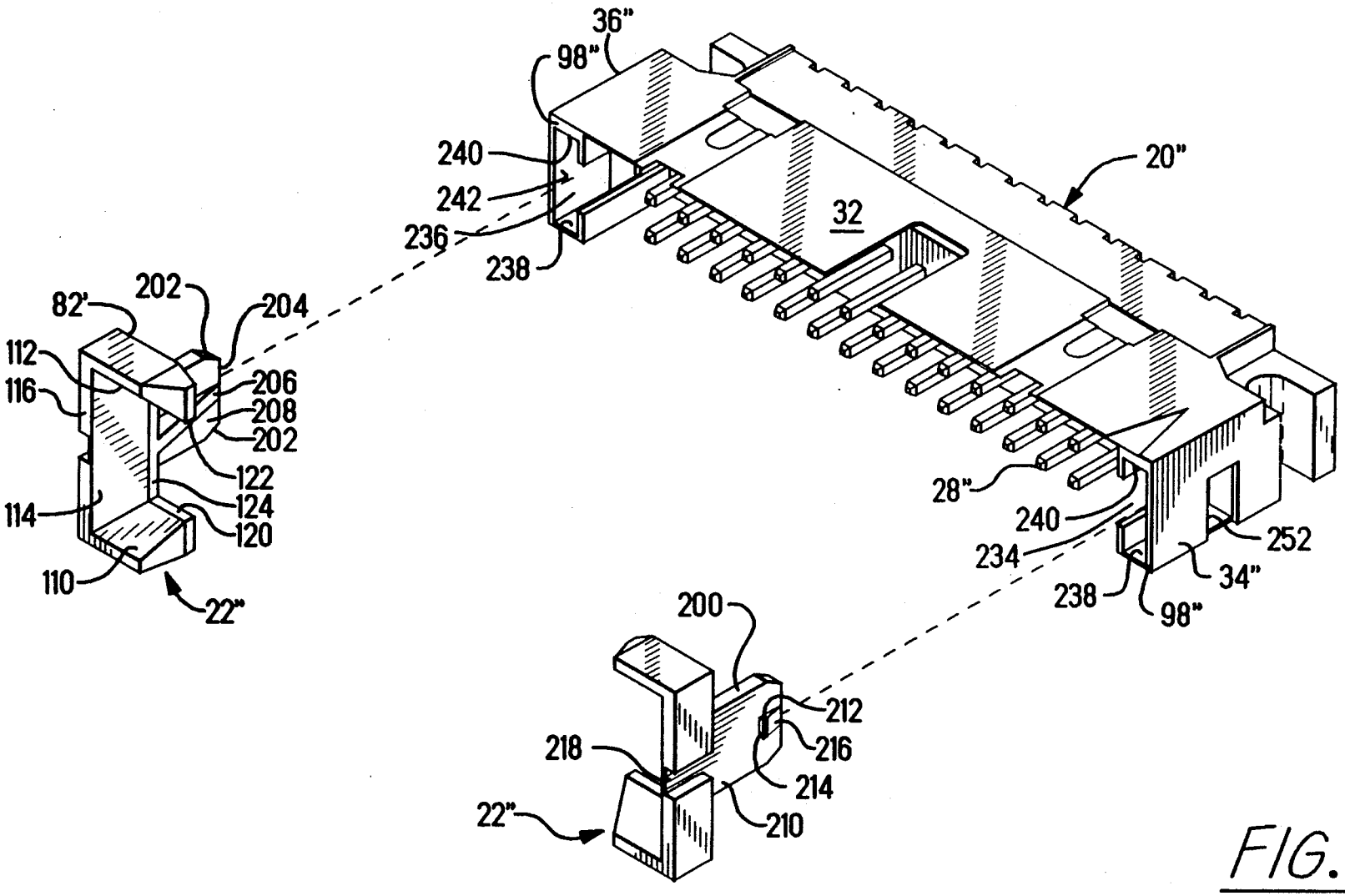
FIG. 9 is a perspective view of an alternate embodiment showing a right angle pin header having two alignment and blind mate assist shrouds in accordance with the present invention, exploded therefrom.

Yet another alternate embodiment alignment and blind mate assist shroud 22'' is shown in FIG. 9 for use with a right angle pin header 20'. The extension section of shroud 22' is substantially the same as the extension section of shroud 22 and therefor will not be described in detail. The body section is comprised of latch arm 200 extending from lower surface 82'. Latch arm 200 has beveled corners 202 adjacent to leading edge 204 and a reinforcing rib 206 upstanding from inward surface 208.

Outward surface 210 of latch arm 200 has a latch protrusion 212 upstanding therefrom near leading edge 204. Protrusion 212 has a latch shoulder 214 facing the extension section and a ramp surface 216 inclined upwardly from surface 210 at leading edge 204. The extension section may have a recess 218 for positioning a core pin during molding of shroud 22'' to form latch shoulder 214.

Figure 10:
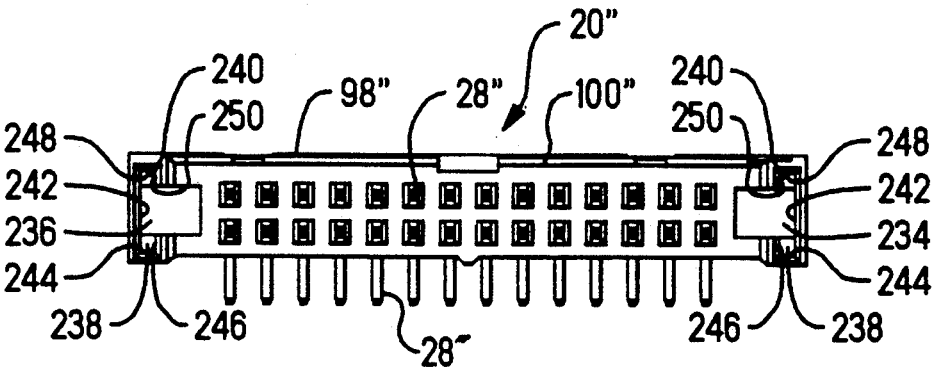
FIG. 10 is a front view of the right angle pin header showing the channels for receiving the blind mate assist shroud latch.

Right angle pin header 20'' has a housing 24'' molded of a suitable plastic with right angle pins 28'' secured therein. Housing 24'' has sidewall 32'' and endwalls 34'' and 36''. Formed adjacent to endwalls 34'' and 36'' are channels 234 and 236. As best seen in FIGS. 9 and 10, each of channels 234 and 236 are themselves a pair of spaced channels 238, 240. Channel 238 is defined between inner endwall surface 242, lower inner surface 244 and surface 246. Channel 240 is defined between inner endwall surface 242, upper inner surface 248 and surface 250. The spacing between lower inner surface 244 and upper inner surface 248 is substantially the width of latch arm 200. Similarly, the spacing between surfaces 246 or 250 and inner endwall surface 242 is substantially the thickness of latch arm 200.

Blind mate assist shrouds 22' are secured to right angle pin header 20' by aligning latch arms 200 with respective channels 234, 236 as shown in FIG. 9. Shrouds 22'' are moved toward pin header 20''. With leading edge 204 received in a channel, bevels 202 assist in vertical positioning of the latch arm 200 in the channel.

Figure 11:
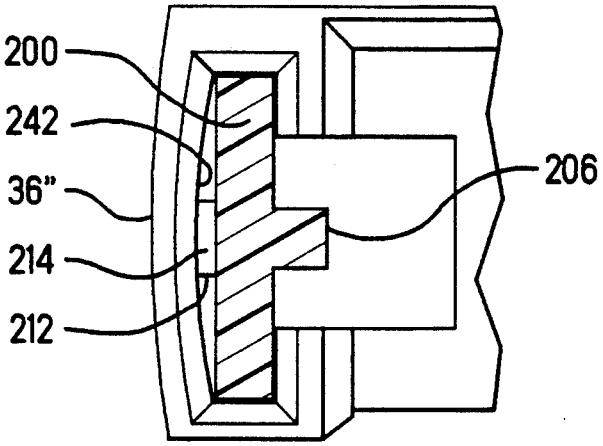
FIG. 11 is a view in a channel as a shroud is secured to the header showing the endwall resiliently deflected outwardly and the latch in cross section.
Figure 13:
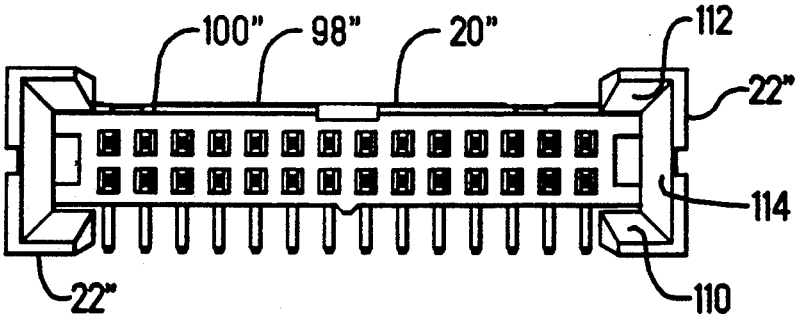
FIG. 13 is a front view of the right angle pin header with the shroud secured thereto.
Figure 12:
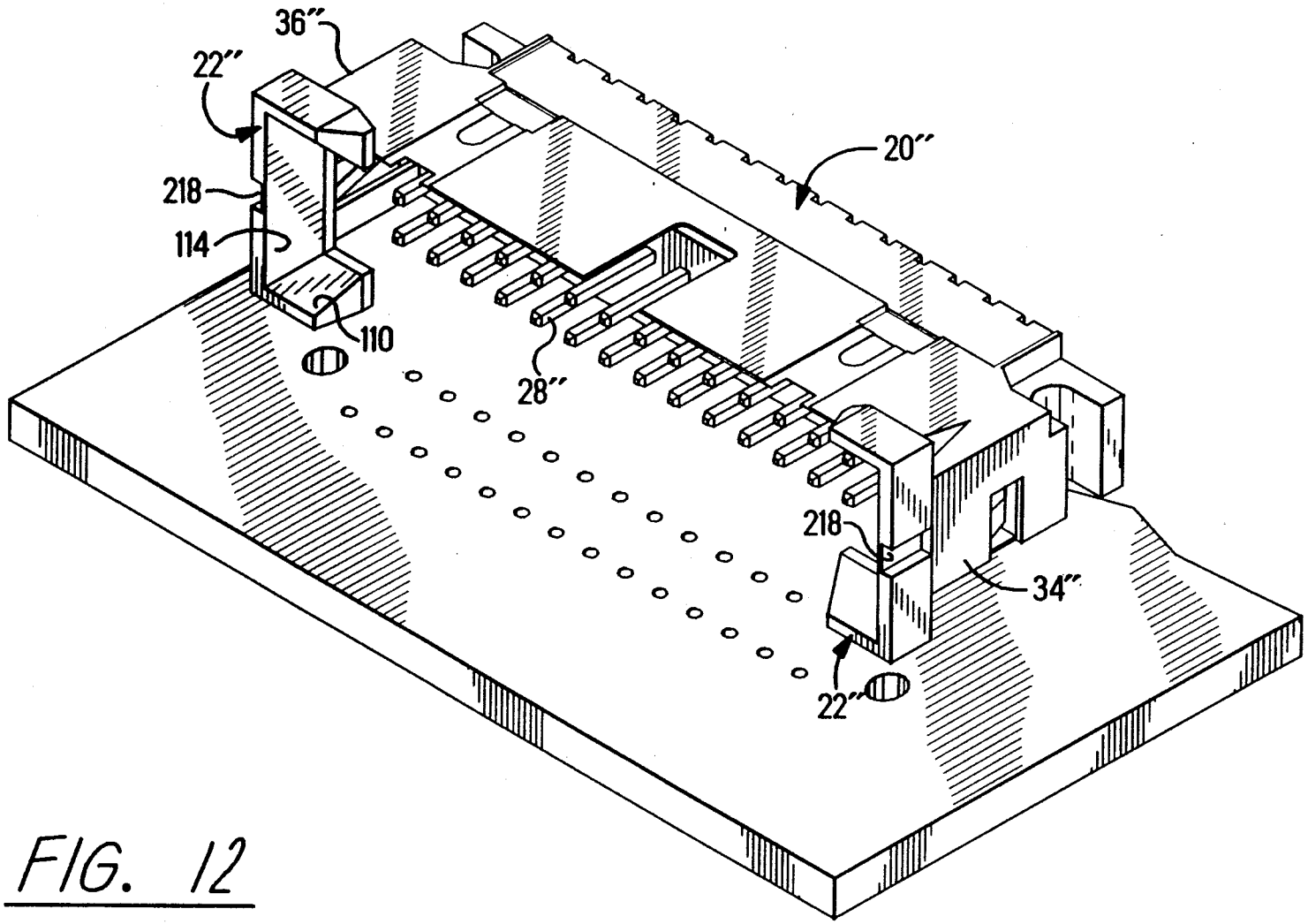
FIG. 12 is a perspective view similar to FIG. 9 with the alignment and blind mate assist shroud secured to the right angle pin header.

With continued movement of shroud 22'' toward header 20'', ramp surface 216 engages inner endwall surface 242, pushes inward surface 208 against 246 and 250, and resiliently deforms the endwall as best seen in FIG. 11. When latch shoulder 214 passes latch surface 252, the endwall resiles inwardly to secure shroud 22'' on right angle pin header 20'' as shown in FIG. 12. Latch shoulder 214 is spaced from lower surface 82'' substantially the same distance that latch surface 252 is spaced from surface 98''. A front view of right angle pin header 20'' with alignment and blind mate assist shrouds 22 secured thereto is shown in FIG. 13.

Figure 14:
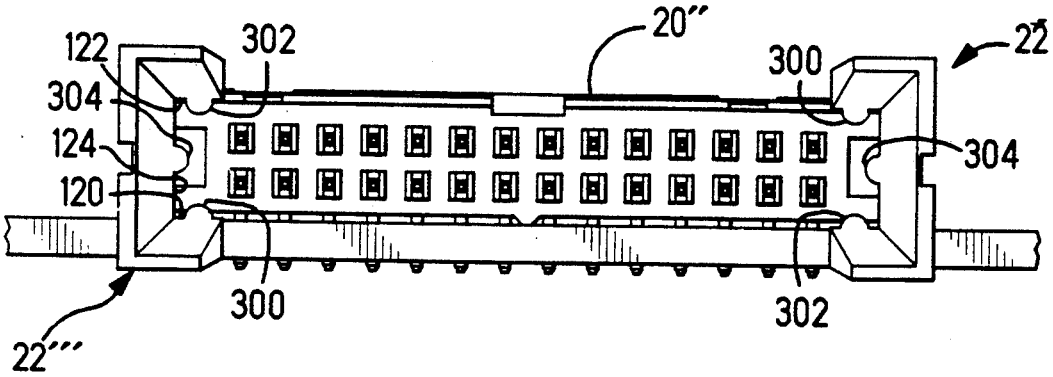
FIG. 14 is a view similar to FIG. 13 showing an alternate embodiment alignment and blind mate assist shroud having connector retaining protrusions.

An alternate embodiment shroud 22''' is shown in FIG. 14 secured to pin header 20. Shroud 22''' has one or more connector retaining protrusions 300, 302 or 304 extending into the area that receives a mating connector. For example protrusion 300 can extend from surface 120; protrusion 302 can extend from surface 122; and protrusion 304 can extend from surface 124. While a single protrusion 300, 302 or 304 will suffice for the purpose of securing a mating connector as discussed in more detail below, the connector retaining protrusions are typically used in pairs and may be used on shrouds for vertical or right angle connectors.

The connector retaining protrusions may provide either lateral or longitudinal detent action. The detent action provides additional retention of the mating connector in the mated position, over and above the retention provided by the normal force of the contacts in the mating connector.

Figure 15:
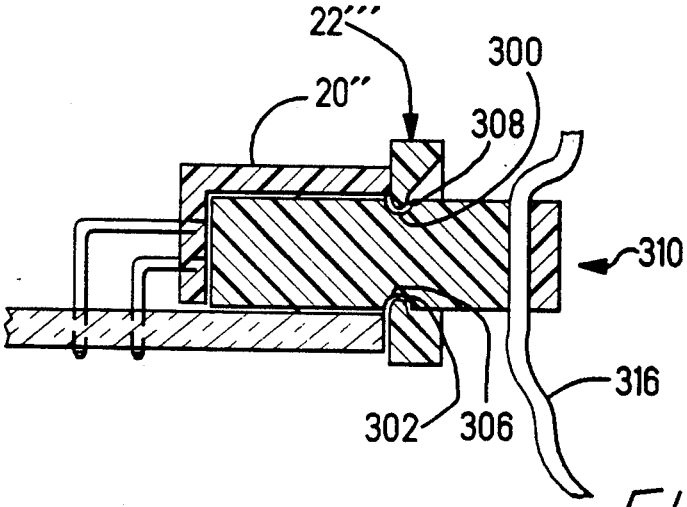
FIG. 15 shows a partial cross section of a right angle connector mounted on a circuit board in which lateral detent action employing the alternate shroud shown in FIG. 14 secures the mating connector in the right angle connector.

Lateral detent action is shown in FIG. 15. A pair of connector retaining protrusions 300,302 cooperate with respective detents or recesses 306,308 in the exterior surface of a mating connector 310 across a minor dimension thereof to secure the mating connector, which is terminated to cable 316, in the mated position. Protrusions 300,302 provide opposed protrusions on the assembly that define a tip-to-tip dimension that is less than a minor dimension of the mating connector. The structure of shroud 22''' flexes open slightly as the mating connector 310 is passed between connector retaining protrusions 300 and 302 both during mating and unmating. In this manner, protrusions 300 and 302 cooperating with recesses or detents 306 and 308 provide a means of securely detent latching a mating connector 310 in connector 20. The protrusions and detents or recesses can take many different shapes and provide a tactile feel indicating a fully mated condition which is especially helpful when the contacts in the connectors are designed for a low mating force.

Figure 16:
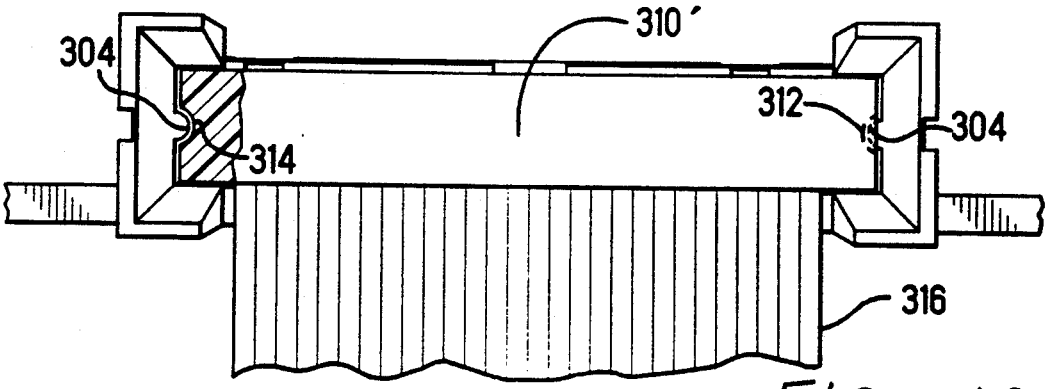
FIG. 16 shows a partial cross section of a right angle connector mounted on a circuit board in which longitudinal detent action employing the alternate shroud shown in FIG. 14 secures the mating connector in the right angle connector.

Longitudinal detent action is shown in FIG. 16. A pair of connector retaining protrusions 304 cooperate with respective detents or recesses 312, 314 to secure mating connector 310' in the mated position. Protrusions 304 provide opposed protrusions on the assembly that define a tip-to-tip dimension that is less than a major dimension of the mating connector. Mating connector 310' is typically a receptacle connector with contacts terminated to conductors of a ribbon cable 316.

I claim:

1. An electrical connector assembly, comprising:

a shrouded header having at least two walls extending to a planar surface, the walls defining inner surfaces, the shrouded header having a plurality of contacts secured therein, said contacts having a first section extending substantially to the planar surface and a second section extending substantially perpendicular thereto; and at least one alignment and blind mate assist shroud secured to said shrouded header, said shroud having a body section and an extension section, said body section having a latch which engages said shrouded header for retaining the shroud on the shrouded header, said extension section extending beyond said planar surface, said extension section having guide means tapering inwardly toward said inner surfaces for guiding a complementary connector into said shrouded header.

2. An electrical connector assembly as recited in claim 1, wherein the shrouded header further comprises at least one latch receiving recess, each said latch receiving recess including a channel defining a pair of closely spaced opposed surfaces to receive said latch therebetween.

3. An electrical connector assembly as recited in claim 2, wherein the shrouded header further comprises a latch surface on a wall thereof, said latch defining a latch shoulder to engage the latch surface and thereby secure the at least one shroud to the shrouded header.

4. An electrical connector assembly as recited in claim 1, wherein said guide means comprises beveled surfaces.

5. An electrical connector assembly as recited in claim 1, wherein the extension section further comprises an alignment surface between said guide means and said planar surface, said alignment surface extending coplanar to at least one of said inner surfaces.

6. An electrical connector assembly, comprising:

a shrouded header having at least two walls extending to a planar surface, the walls defining inner surfaces, the shrouded header having a plurality of contacts secured therein, said contacts extending to the planar surface, at least one latch receiving recess, each said latch receiving recess including a channel defining a pair of closely spaced opposed surfaces; and at least one alignment and blind mate assist shroud secured to said header, said shroud having a body section and an extension section, said body section having a latch received in said at least one latch receiving recess, said latch engaging said shrouded header for retaining the shroud on the shrouded header, said extension section extending beyond said planar surface, said extension section having guide means tapering inwardly toward said inner surfaces for guiding a complementary connector into said shrouded header.

7. An electrical connector assembly as recited in claim 6, wherein the shrouded header further comprises a latch surface on a wall thereof, said latch defining a latch shoulder to engage the latch surface and thereby secure the at least one shroud to the shrouded header.

8. An electrical connector assembly as recited in claim 6, wherein the contacts are formed to have two portions substantially perpendicular to each other.

9. An electrical connector assembly as recited in claim 6, wherein the guide means comprise beveled surfaces.

10. An electrical connector assembly as recited in claim 6, wherein the extension section further comprises an alignment surface between said guide means and said planar surface, said alignment surface extending coplanar to at least one of said inner surfaces.

11. An electrical connector assembly, comprising:

a shrouded header having at least two walls extending to a planar surface, the walls defining inner surfaces, the shrouded header having a plurality of contacts secured therein, said contacts extending to the planar surface; and a pair of alignment and blind mate assist shrouds, one secured to each of said walls, each said shroud having a body section having a latch which engages said shrouded header for retaining the shroud on the shrouded header, each shroud having an extension section, each extension section extending beyond said planar surface, each extension section having guide means tapering inwardly toward said inner surfaces for guiding a complementary connector into said shrouded header.

12. An electrical connector assembly as recited in claim 11, wherein the contacts have two portions substantially perpendicular to each other.

13. An electrical connector assembly as recited in claim 11, wherein the guide means comprise beveled surfaces.

14. An electrical connector assembly as recited in claim 13, wherein a beveled surface on each shroud extends inwardly toward said inner surfaces and toward a beveled surface on the other shroud.

15. An electrical connector assembly as recited in claim 11, wherein the extension section of each shroud further comprises an alignment surface between respective guide means and said planar surface, said alignment surface extending coplanar to at least one of said inner surfaces.

16. An electrical connector assembly, comprising:

a shrouded header having at least two walls extending to a planar surface, the walls defining inner surfaces, the shrouded header having a plurality of contacts secured therein; and at least one alignment and blind mate assist shroud securable to said shrouded header, said shroud having a body section and an extension section, said body section secured to said shrouded header, said extension section having opposed protrusions cooperable with recesses on a mating connector to provide additional retention of the mating connector when mated with the shrouded header.

17. An electrical connector assembly as recited in claim 16, wherein the protrusions are positioned across a minor dimension of the assembly thereby providing lateral detent action.

18. An electrical connector assembly as recited in claim 16, wherein the protrusions are positioned across a major dimension of the assembly thereby providing longitudinal detent action.

19. An electrical connector assembly as recited in claim 16, wherein the extension section further comprises guide means.

20. An electrical connector assembly as recited in claim 19, wherein the extension section further comprises alignment surfaces between said guide means and said planar surface, said opposed protrusions extending from said alignment surfaces.

* * * * *